US005431002A

United States Patent [19]

Treptow

[11] Patent Number: 5,431,002

[45] Date of Patent: Jul. 11, 1995

[54] FALSE TWIST CRIMPING MACHINE

[75] Inventor: Heinz Treptow, Ennepetal, Germany

[73] Assignee: Barmag AG, D-42862 Remscheid, Germany

[21] Appl. No.: 134,117

[22] Filed: Oct. 8, 1993

[30] Foreign Application Priority Data

Oct. 8, 1992 [DE] Germany ..... 42 33 856.5
Oct. 31, 1992 [DE] Germany ..... 42 36 842.1
Dec. 3, 1992 [DE] Germany ..... 42 40 659.5

[51] Int. Cl.[6] ..... D01H 13/04; D01H 5/28

[52] U.S. Cl. ..... 57/279; 57/261; 57/280; 57/290; 57/291; 57/352

[58] Field of Search ..... 57/261, 279, 280, 284, 57/289, 290, 291, 350, 351, 348, 352; 242/131, 131.1; 28/249; 57/1 R

[56] References Cited

U.S. PATENT DOCUMENTS

| | | | |
|---|---|---|---|
| Re. 30,159 | 11/1979 | Kubler | 57/291 |
| 3,395,433 | 8/1968 | Kodaira et al. | 28/62 |
| 3,942,312 | 3/1976 | Venot | 57/280 |
| 3,946,546 | 3/1976 | Venot | 57/291 |
| 3,962,829 | 6/1976 | Schippers | 57/34 HS |
| 3,991,545 | 11/1976 | Ritter et al. | 57/280 |
| 3,999,360 | 12/1976 | Forin et al. | 57/280 |
| 4,079,898 | 3/1978 | Murakami et al. | 242/35.5 A |
| 4,201,036 | 5/1980 | Schellenberg et al. | 57/291 |
| 4,339,915 | 7/1982 | Dammann et al. | 57/339 |
| 4,362,010 | 12/1982 | Crouzet | 57/280 X |
| 4,362,011 | 12/1982 | Kikuchi | 57/291 |
| 4,809,494 | 3/1989 | Dammann | 57/291 |
| 4,905,468 | 3/1990 | Tanae et al. | 57/291 |

FOREIGN PATENT DOCUMENTS

| | | |
|---|---|---|
| 0330368 | 8/1989 | European Pat. Off. . |
| 2067095 | 8/1971 | France . |
| 2219257 | 9/1974 | France . |
| 2226489 | 11/1974 | France . |
| 2165182 | 7/1972 | Germany . |
| 2243791 | 3/1973 | Germany . |
| 2350558 | 5/1974 | Germany . |
| 2363160 | 5/1975 | Germany . |
| 2449335 | 6/1975 | Germany . |

*Primary Examiner*—Daniel P. Stodola
*Assistant Examiner*—William Stryjewski
*Attorney, Agent, or Firm*—Bell, Seltzer, Park & Gibson

[57] ABSTRACT

A false twist crimping machine has a secondary heater positioned downstream of the false twist zone, which comprises a slightly curved, upright, externally heated tube. The upright heating tube has a downstream end which connects with a horizontally directed transport tube which extends laterally across the service aisle of the machine adjacent the floor, and to a side frame which mounts the package take-up system. The inside diameter and length of the transport tube closely correspond to the inside diameter and length of the heating tube.

14 Claims, 3 Drawing Sheets

FALSE TWIST CRIMPING MACHINE

BACKGROUND OF THE INVENTION

The present invention relates to a false twist crimping machine of the type disclosed in U.S. Pat. Nos. 4,809,494, 3,962,829 and Re. No. 30,159.

False twist crimping machines serve to crimp endless thermoplastic filament yarns. Such filament yarns are initially spun as flat yarns, and in the false twist crimping machine, a plurality of yarns are processed in side by side parallel working stations. More particularly, each yarn is initially withdrawn from its supply package by a first feed system, then heated in a heater to about 220° C., subsequently cooled, and then advanced through a false twist unit. A second feed system withdraws the yarn from the false twist unit.

The above described false twist method results in a permanent crimp being imparted to the yarn. Crimp values (in accordance with DIN [German Industrial Standards] 53840) amount to 40–50%. However, in many applications, attempts are made to reduce this final crimp behavior substantially. To this end, a secondary heating tube is used at each processing station. This heating tube is arranged between the second and a third feed system, and in the known false twist crimping machine, each tube externally heated. For heating, a heated vapor is preferably used, which achieves a uniformity of heating among the stations.

The effect of the heating tube is dependent on the method parameters of the heating zone. Decisive parameters are in particular the speed of the third feed system, the temperature of the heating tube, as well as its length. A certain deceleration of the yarn speed is generally provided by the third feed system, so as to reduce the yarn tension in the secondary heating tube. However, this deceleration, i.e. the speed difference between the second feed system and third feed system should not become too great, inasmuch as the yarn will slacken and result in yarn breakage. Furthermore, the threadline will become unstable, which leads to so-called voids, i.e. unevennesses of the yarn which later becomes visible in the fabric formed from the yarn.

It is accordingly an object of the present invention to improve and intensify the heating effect of the secondary heating tube of a yarn false twist crimping machine, by a novel design and construction of the heating tube.

SUMMARY OF THE INVENTION

The above and other objects and advantages of the present invention are achieved in the embodiments illustrated herein by the provision of a yarn false twist crimping machine which comprises means for advancing a yarn along a path of travel, and false twist crimping means disposed along the path of travel and including means for serially heating, cooling, and false twisting the advancing yarn. Heat setting means is disposed along the path of travel downstream of the false twist crimping means, which comprises a heating tube and a non-heated transport tube fixed to the downstream end of said heating tube. The transport tube has an inside diameter which closely corresponds in size to the inside diameter of the heating tube, and such that the advancing yarn passes serially through the heating tube and the transport tube.

In a preferred embodiment, the machine includes a central frame, and a side frame which is laterally spaced from the central frame so as to define a service aisle therebetween. The false twisting means of each station is mounted on the central frame, and the heating tube is also mounted on the central frame in a generally upright orientation. Also, the non-heated transport tube extends in a generally horizontal direction laterally across the service aisle adjacent the floor and to the side frame, and yarn winding means is mounted on the side frame for receiving the advancing yarn from the transport tube and winding the same into a package.

The present invention has the advantage that in comparison with currently known heater designs, it is possible to operate with a considerably increased deceleration. Furthermore, with the same heating effect, it is possible to reduce the temperatures substantially, which results in a protective treatment of the yarn and savings of energy. A heater temperature of about 180° allows crimping values (for example, 12%) to be reached, which can be reached in conventional heaters only with temperatures of more than 200°.

In accordance with the present invention, the actual heating tube may be constructed of a considerably shorter length than in the past. A substantially sealed, preferably seamless connection is provided with the transport tube, which is not externally heated and which, as experience shows, need not be even insulated, and allows a heat compensation to occur within the entire cross section of the yarn, which replaces by sections the conventional, active heating of the yarn. The connection of the transport tube, which is here described as sealing or seamless, does not mean that the two tubes merge into one another without discontinuity, but that access of air is absent at the transition from one tube to the other.

The very great length of the heating tube including the transport tube necessitate an operator-friendly construction. This problem is solved by the provision of a central frame and a laterally separated side frame, in the manner described above.

It is important that too high of a yarn tension build up be avoided in the transport tube or at the connector between the heating tube and the transport tube, at which the yarn path is turned from a substantially vertical to a substantially horizontal direction. This is accomplished with the features of the present invention.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
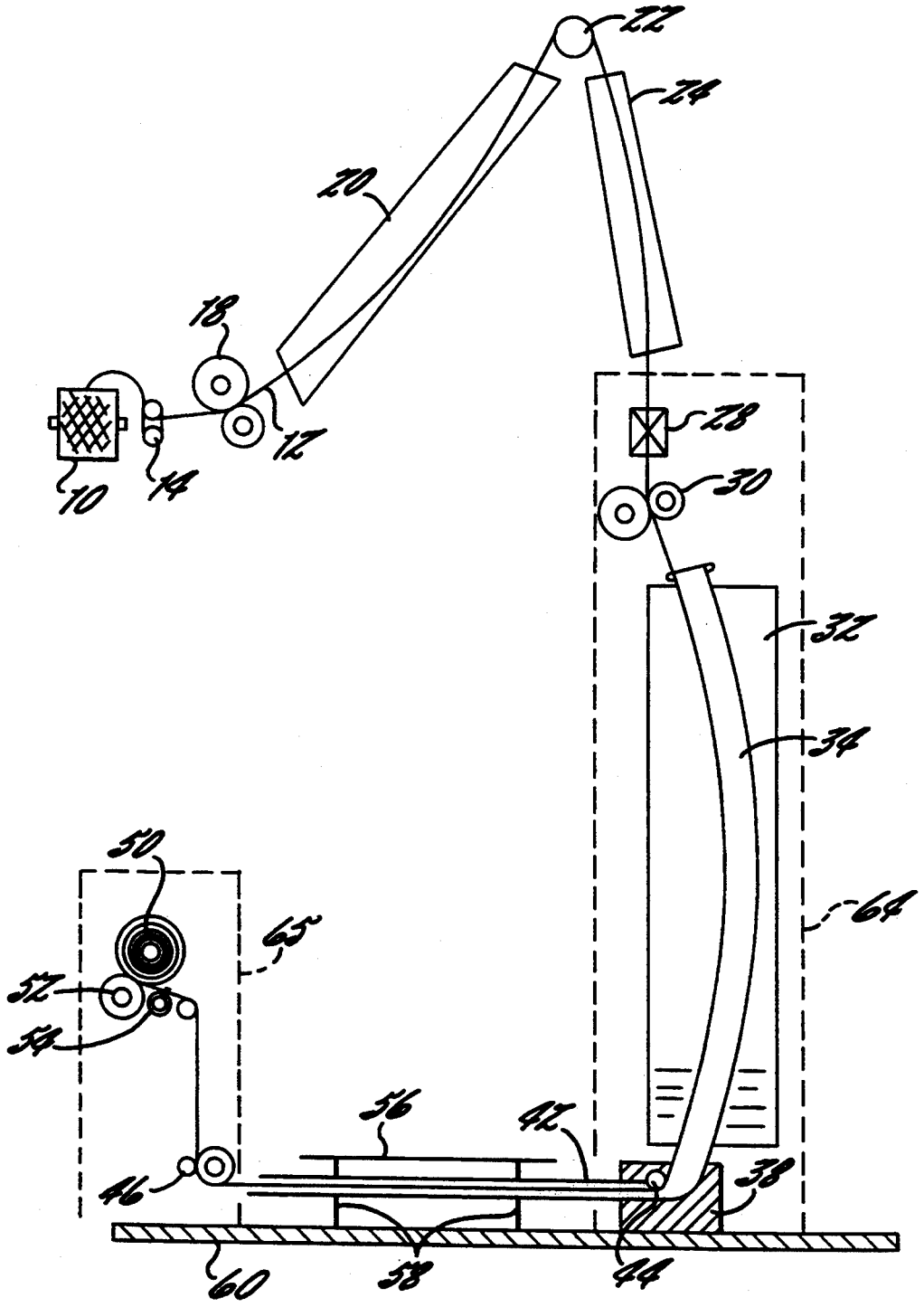
FIG. 1 is a cross sectional schematic view of a false twist machine designed and constructed in accordance with the invention.

Referring more particularly to the drawings, a false twist crimping machine is schematically illustrated in FIG. 1, which embodies the present invention. The machine comprises a creel (not shown) which supports a feed yarn package 10, on which a thermoplastic filament yarn 12 is wound. The yarn 12 is withdrawn via deflecting rolls 14 under a certain tension by a feed system 18. In the direction of the advancing yarn, downstream of feed system 18, a first, elongate heater 20 is arranged, through which the yarn 12 advances, and in so doing is heated to a certain temperature. Subsequent to heater 20, a further deflecting yarn guide 22 is positioned, which deflects the yarn and advances it to a cooling plate 24. Heater 20 and cooling plate 24 may be oriented relative to one another approximately in the fashion of a roof, with deflection yarn guide 22 forming the apex of the rooflike structure. Located downstream of cooling plate 24 is a schematically illustrated false twist unit 28. The latter may be designed and constructed in accordance with DE-PS 22 13 881 or U.S. Pat. No. 4,339,915. Subsequent to false twist unit 28, a further feed system 30 is positioned, which serves to draw yarn 12 both over heater 20 and cooling plate 24.

In direction of ,the advancing yarn, downstream of feed system 30, a heating tube 34 is positioned, which is constructed preferably as a curved, tubular member which is surrounded by a heating jacket 32. The heating tube 34 may alternatively be constructed as a linear tube. The heating jacket 32 serves to heat the tube 34 from its outside with vapor at a certain elevated temperature. Adapted to the spatial conditions of the false twist crimping machine, the heating tube 34 and its jacket 32 are preferably arranged in an upright orientation.

Seamlessly connected to the downstream or lower end of the heating tube 34, i.e. substantially sealed against air, is a transport tube 42. This allows for the yarn 12 to transport the atmosphere of heating tube 34 into transport tube 42. A connecting member 38 is provided to interconnect the downstream end of the heating tube 34 to the upstream end of the transport tube 42, and at the right angled elbow in the member there is provided a yarn guide 44 which is constructed as a pin or roll which has a circumferential groove. The groove serves to guide the yarn 12 with the least possible friction from heating tube 34 into the transport tube 42. Surprisingly, it has been found that the heated air entrained by yarn 12 from the heating tube 34 leads to a further reduction of the crimp imparted to yarn 12 in false twist zone 28, despite the relatively low temperature of the heating tube 34, for example, approximately 160° to 180° C., than has been possible with known heating tubes.

At the outlet end of the transport tube 42, a further yarn feed system 46 is positioned. The latter may be followed by a device (not shown) for applying a finish to the yarn 12. The yarn is then wound into a takeup package 50, which is driven on its circumference by a friction roll 52. Arranged upstream of friction roll 52 is a traversing system 54, by which yarn 12 is reciprocated along package 50 and taken up so as to form a cross wind.

Higher temperatures make it possible to obtain lower crimps, for example 12%, which otherwise can be obtained only with heating tubes of a greater length. This results in a better utilization of heat and savings of energy.

It should also be noted that an insulation of the transport tube 42 has been found to be unnecessary, and often not even desirable, so as to bring the yarn at the end of the tube to a temperature below 100° C.

Arranged above the transport tube 42 is a platform 56 which is supported by rails or posts 58 on the floor 60, and which serves as an operator walkway.

In a preferred embodiment, the machine of the present invention comprises a central frame, shown schematically at 64 in FIG. 1, which mounts the false twist device 28, the feed rolls 30 and the upright heating tube 34 and its jacket 32. A side frame, shown schematically at 65, is also provided which is laterally spaced from the central frame so as to define a service aisle therebetween. The side frame 65 supports the package take-up system 52, 54, and it is positioned between the creel (not shown) for the package 10 and the service aisle at 56. As will be seen from the drawings, the heater 20 and the cooling plate 24 are positioned above the service aisle.

Figure 2:
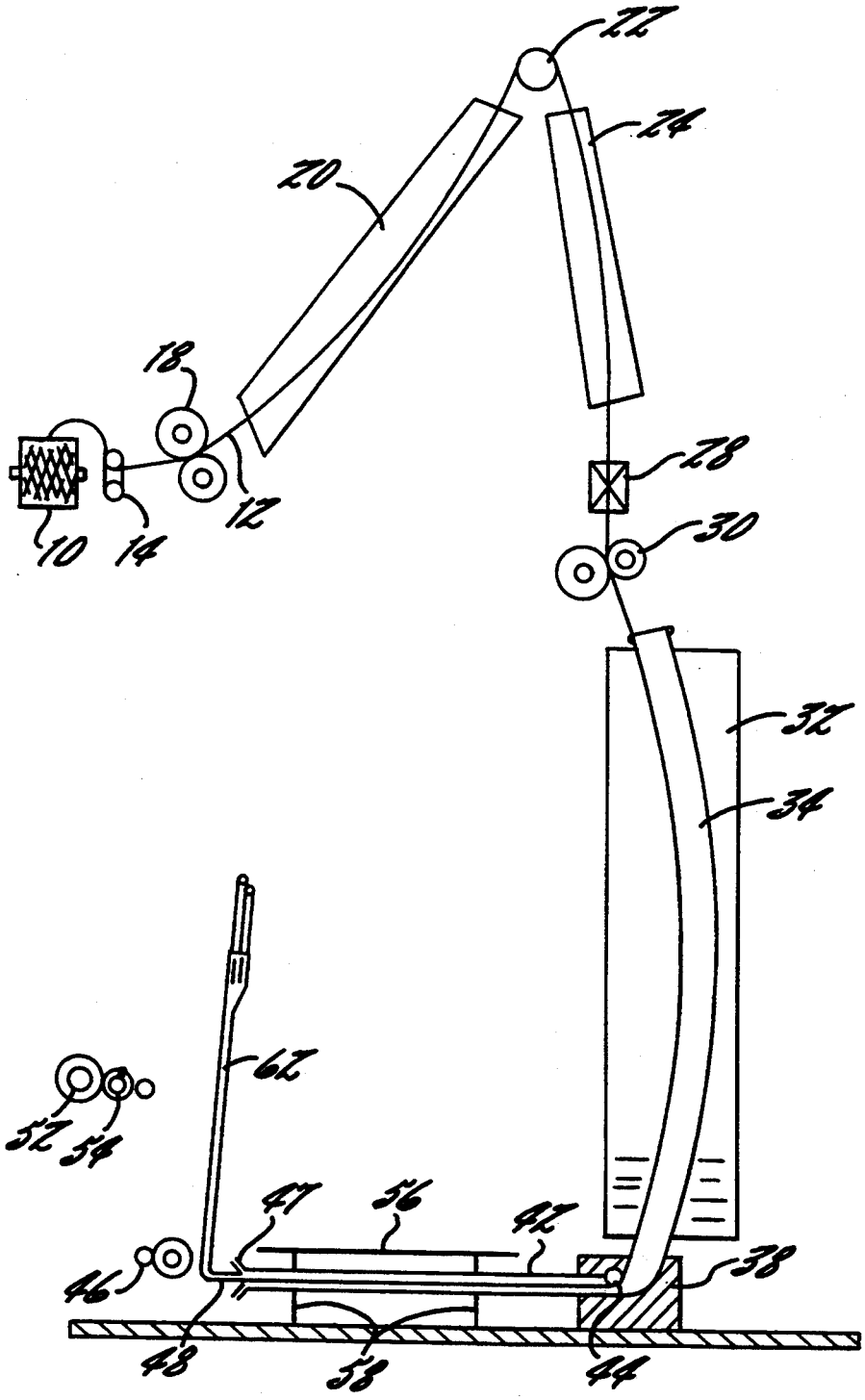
FIG. 2 is a cross sectional schematic view of a false twist machine of the present invention, and illustrating a first embodiment of a device for threading the yarn into the heating and transport tubes.
Figure 3:
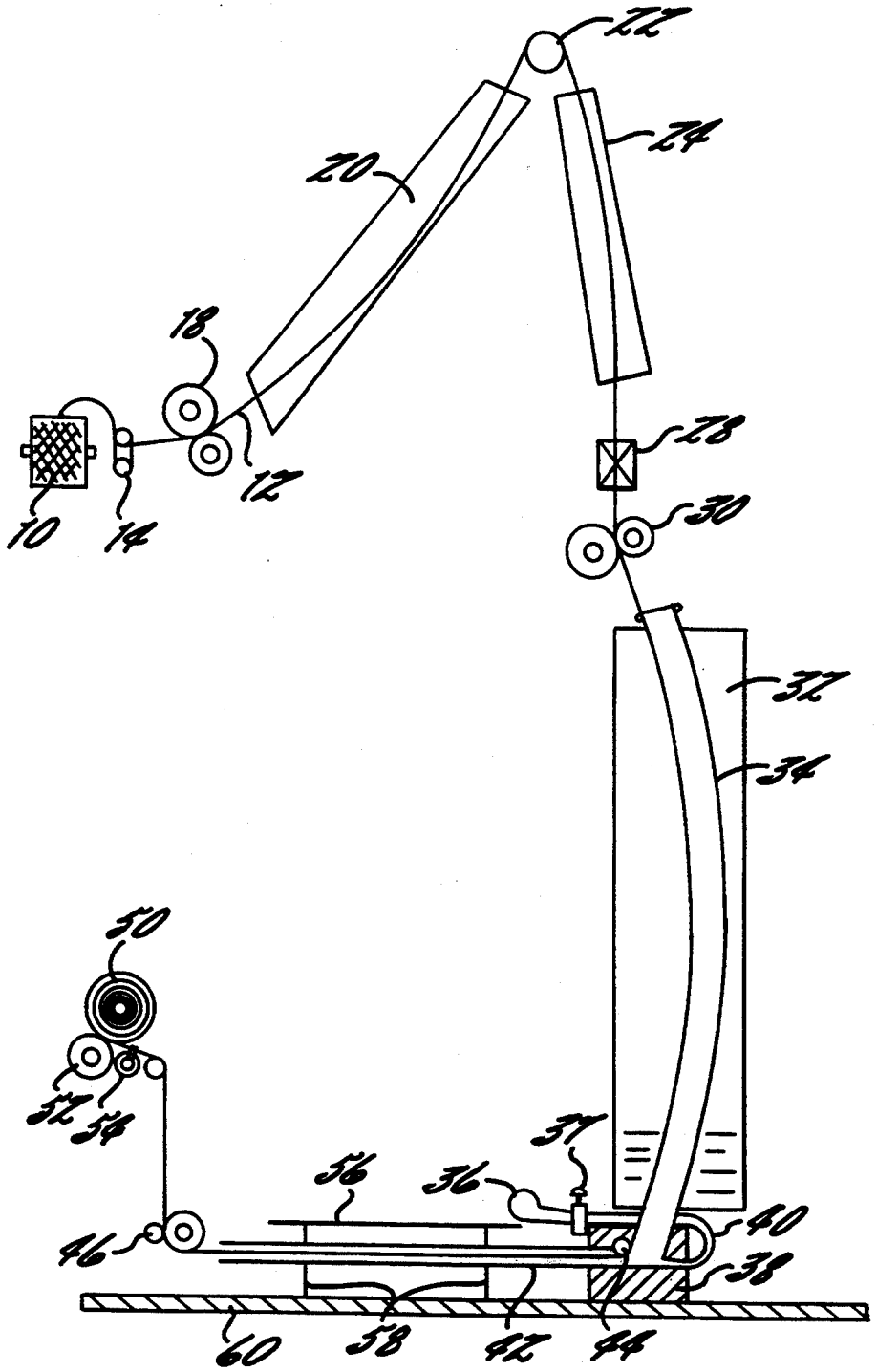
FIG. 3 is a cross sectional schematic view of a false twist crimping machine of the present invention, and illustrating a different embodiment for threading a yarn through the heating and transport tubes.

The false twist crimping machine shown in FIGS. 2 and 3 corresponds entirely to the machine of FIG. 1, the description of which is herewith referred to. The machine of FIG. 2, however, differs from that of FIG. 1, in that at the outlet end of transport tube 42 a mouthpiece or outlet end 47 is provided in the form of a funnel-shaped widening of the tube. If the need arises, a suction nozzle or orifice 48 of a suction gun 62 which is connected via conventional hoses with a source of vacuum, may be applied to this mouthpiece 47, so as to pull a yarn through heating tube 34 and transport tube 42, as is common practice at the beginning of a new winding operation. To this end, the end of yarn 12 advancing from feed yarn package 10 is pulled in a simple step to the inlet end of heating tube 34 and then pulled with suction gun 62 through both tubes 34 and 42. Thereafter, the yarn 12 advances via the feed system 46 to the traversing system 54 and then to takeup package 50.

The machine of FIG. 3 differs from that of FIG. 2 in that it is provided with a different yarn threading device. In this embodiment, the latter is a device operated by overpressure. To this end, a source of compressed air 36 is connected to a duct 38 via a tube 40. The tube 40 is provided with a valve 37, and extends behind the junction of the heating tube and the transport tube. Upon opening the valve 37, a surge of compressed air flows via duct 38 through the transport tube 42, which produces in heating tube 34 a suction effect. The latter allows the yarn 12 to be drawn or blow through the heating and transport tubes, when the yarn is held in front of the inlet end of heating tube 34.

The heating tube 34 generally corresponds in its dimensions with respect to diameter and length to the dimensions of transport tube 42. The transport tube 42 is unheated, but is heated to a certain degree by the hot air entrained from the heating tube 34 by the advancing yarn 12. However, the influence of the heat decreases continuously from the inlet end to the outlet end of transport tube 42, which is possibly contributory to the unexpectedly advantageous effect provided by the transport tube.

In a preferred embodiment, the dimensions of heating tube and transport tube are identical, except that the heating tube 34 is curved, for example, by a radius ranging from 4 to 10 meters. This curvature causes the advancing yarn to engage the inside portion of the bore of the heating tube, as seen in the drawings. The transport tube is substantially linear. The length of each tube is between 1 meter and 1.5 meters, and the inside diameter of each tube is between 3 and 12 millimeters.

As one specific example, the heating tube 34 measured 1300 mm long and had an inside diameter of 4 mm. The transport tube 42 measured 1300 mm long and had an inside diameter of 4 mm.

In the drawings and specifications, there has been set forth a preferred embodiment of the invention, and although specific terms are employed, they are used in a generic and descriptive sense only and not for purposes of limitation.

That which is claimed is:

1. A yarn false twist crimping machine comprising means for advancing a yarn along a path of travel, false twist crimping means disposed along said path of travel for false twist crimping the advancing yarn and including means for serially heating, cooling, and false twisting the advancing yarn, secondary heating means disposed along said path of travel downstream of said false twist crimping means and comprising a heating tube, a non-heated transport tube fixed to the downstream end of said heating tube, with said transport tube having an inside diameter which closely corresponds in size to the inside diameter of said heating tube, and such that the advancing yarn passes serially through said heating tube and said transport tube, and a connecting member interconnecting said heating tube and said transport tube in a generally right angled relationship, said connecting member including a compressed air line for delivering compressed air therein in a direction aligned with said transport tube and for effecting thread-up of a yarn through said tubes.

2. The yarn false twist crimping machine as defined in claim 1 wherein the length of said transport tube substantially corresponds to the length of said heating tube.

3. The yarn false twist crimping machine as defined in claim 1 wherein said heating tube has an internal bore which is curved along its length and so as to define an inside portion of relatively short radius of curvature and an outside portion of a longer radius of curvature, and so that the advancing yarn engages the inside portion of the bore of said heating tube.

4. The yarn false twist crimping machine as defined in claim 1 wherein said heating tube and said transport tube each has an internal bore, and wherein said transport tube is joined to the downstream end of said heating tube so as to provide an air tight interconnection between said internal bores.

5. The yarn false twist crimping means as defined in claim 1 further comprising means for heating said heating tube from its outside.

6. The yarn false twist crimping machine as defined in claim 1 wherein said heating tube is positioned in a generally upright orientation, and said transport tube extends from said heating tube in a generally horizontal direction.

7. The yarn false twist crimping machine as defined in claim 1 further comprising winding means positioned along said path of travel downstream of said transport tube for winding the advancing yarn into a package.

8. The yarn false twist crimping machine as defined in claim 1 further comprising a mouthpiece formed at the downstream end of said transport tube and adapted to receive a suction nozzle therein for effecting thread-up of a yarn through said tubes.

9. The yarn false twist crimping machine as defined in claim 1 wherein said connecting member includes a deflection roll for guiding the advancing yarn between said tubes.

10. A yarn false twist crimping machine comprising a central frame, a side frame laterally space from said central frame so as to define a service aisle therebetween, false twist imparting means for imparting false twist to an advancing yarn and comprising serially arranged means for heating, means for cooling, and means for false twisting the advancing yarn, and with said means for false twisting the advancing yarn being mounted on said central frame, a heating tube mounted on said central frame in a generally upright orientation for receiving the advancing yarn from said false twist imparting means and heating the same, a non-heated transport tube connected to the downstream end of said heating tube and extending in a generally horizontal direction laterally across said service aisle and to said side frame, and such that the advancing yarn passes serially through said heating tube and said transport tube, a connecting member interconnecting said heating tube and said transport tube in a generally right angled relationship, said connecting member including a compressed air line for delivering compressed air therein in a direction aligned with said transport tube and for effecting thread-up of a yarn through said tubes, and yarn winding means mounted on said side frame for receiving the advancing yarn from said transport tube and winding the same into a wound package.

11. The yarn false twist crimping machine as defined in claim 10 wherein said means for heating and said means for cooling are positioned above said service aisle.

12. The yarn false twist crimping machine as defined in claim 10 wherein said central frame and said side frame are positioned on a supporting floor, and wherein said transport tube is positioned immediately adjacent said floor.

13. The yarn false twist crimping machine as defined in claim 10 further comprising an operator walkway positioned in said service aisle immediately above said transport tube.

14. The yarn false twist crimping machine as defined in claim 10 further comprising means for advancing a yarn through said machine and comprising first yarn feeding means positioned upstream of said false twist imparting means, second yarn feeding means positioned on said central frame and between said false twist imparting means and said heating tube, and third yarn feeding means positioned on said side frame and between said transport tube and said yarn winding means.

* * * * *